US005348222A

United States Patent [19]

Patey

[11] Patent Number: 5,348,222

[45] Date of Patent: Sep. 20, 1994

[54] GARBAGE CONTAINER

[76] Inventor: Roy Patey, 174 Berkindale Drive, Stoney Creek, Ontario, Canada, L8E 1M5

[21] Appl. No.: 15,102

[22] Filed: Feb. 9, 1993

[51] Int. Cl.[5] ..... B65D 91/00

[52] U.S. Cl. ..... 232/43.2; 220/262; 220/908; 312/290; 248/134

[58] Field of Search ..... 232/1 R, 19, 20, 27, 232/28, 41 R, 43.1, 43.2; 248/134; 220/908, 909, 262; 312/275, 290, 325, 319.9

[56] References Cited

U.S. PATENT DOCUMENTS

| | | | |
|---|---|---|---|
| 908,543 | 1/1909 | Brown | 232/28 |
| 1,083,304 | 1/1914 | Straubel | 312/290 |
| 1,181,526 | 5/1916 | Hawk | 312/275 |
| 1,323,775 | 12/1919 | Kroff | 248/134 |
| 1,891,651 | 12/1932 | Padelford et al. . | |
| 2,435,105 | 1/1948 | Solomon . | |
| 2,533,524 | 12/1950 | Snider . | |
| 2,537,363 | 1/1951 | Minor | 248/134 |
| 2,593,455 | 4/1952 | James . | |
| 2,934,390 | 4/1960 | Wright | 312/319.9 |
| 3,081,025 | 3/1963 | Griffiths | 232/28 |
| 4,361,247 | 11/1982 | Williams . | |
| 5,011,036 | 4/1991 | Souza et al. . | |
| 5,090,785 | 2/1992 | Stamp | 312/290 |
| 5,147,055 | 9/1992 | Samson et al. | 220/908 |

*Primary Examiner*—Michael Milano
*Attorney, Agent, or Firm*—Rogers & Scott

[57] ABSTRACT

A garbage container has a housing with a rear wall, opposite side walls extending forwardly therefrom and a lid hingedly connected to the top of the rear wall and extending forwardly therefrom so as to rest on the top of the side walls in a closed position. A waste supporting platform is located within the housing and is pivotally connected adjacent its front edge to the opposite side walls for pivotal movement about a horizontal axis. A front wall extends upwardly from the front edge of the platform and has a top edge level with the top of the side walls in the closed position. A connecting member is pivotally connected to a rear portion of the platform and to a rear portion of the underside of the lid to cause upward opening movement of the lid to pivot the platform upwardly about its pivotal connection to the side walls with resultant forward pivotal movement of the front wall to facilitate access to the interior of the container.

2 Claims, 2 Drawing Sheets

GARBAGE CONTAINER

This invention relates to garbage containers of the kind which are generally used for domestic purposes.

It is well known to provide a domestic garbage container with a lid which can be opened by operation of a foot pedal. However, most garbage containers of this type do not provide sufficiently adequate access to the interior of the container as is often desirable.

Is is therefore an object of the invention to provide a domestic garbage container with improved access to its interior when the lid is open.

According to the invention, a garbage container has a housing with a rear wall, opposite side walls extending forwardly therefrom and a lid hingedly connected to the top of the rear wall and extending forwardly therefrom so as to rest on the top of the side walls in a closed position. A waste supporting platform is located within the housing and is pivotally connected adjacent its front edge to the opposite side walls for pivotal movement about a horizontal axis. A front wall extends upwardly from the front edge of the platform and has a top edge level with the top of the side walls in the closed position. A connecting member is connected to a rear portion of the platform and to a rear portion of the underside of the lid to cause upward opening movement of the lid to pivot the platform upwardly about its pivotal connection to the side walls with resultant forward pivotal movement of the front wall to facilitate access to the interior of the container.

The container may also have a pedal member mounted within the housing below the platform for pivotal movement about a horizontal axis intermediate to the front and rear ends of the pedal member, the connecting member also being pivotally connected to a rear portion of the pedal member, and the pedal member having a front portion adjacent to the front of the housing moveable downwardly by a human foot to cause upward movement of the rear portion of the pedal member with consequent upward movement of the connecting member to effect the upward pivotal movement of the lid and platform and forward pivotal movement of the front wall.

One embodiment of the invention will now be described, by way of example, with reference to the accompanying drawings, of which:

Figure 2:
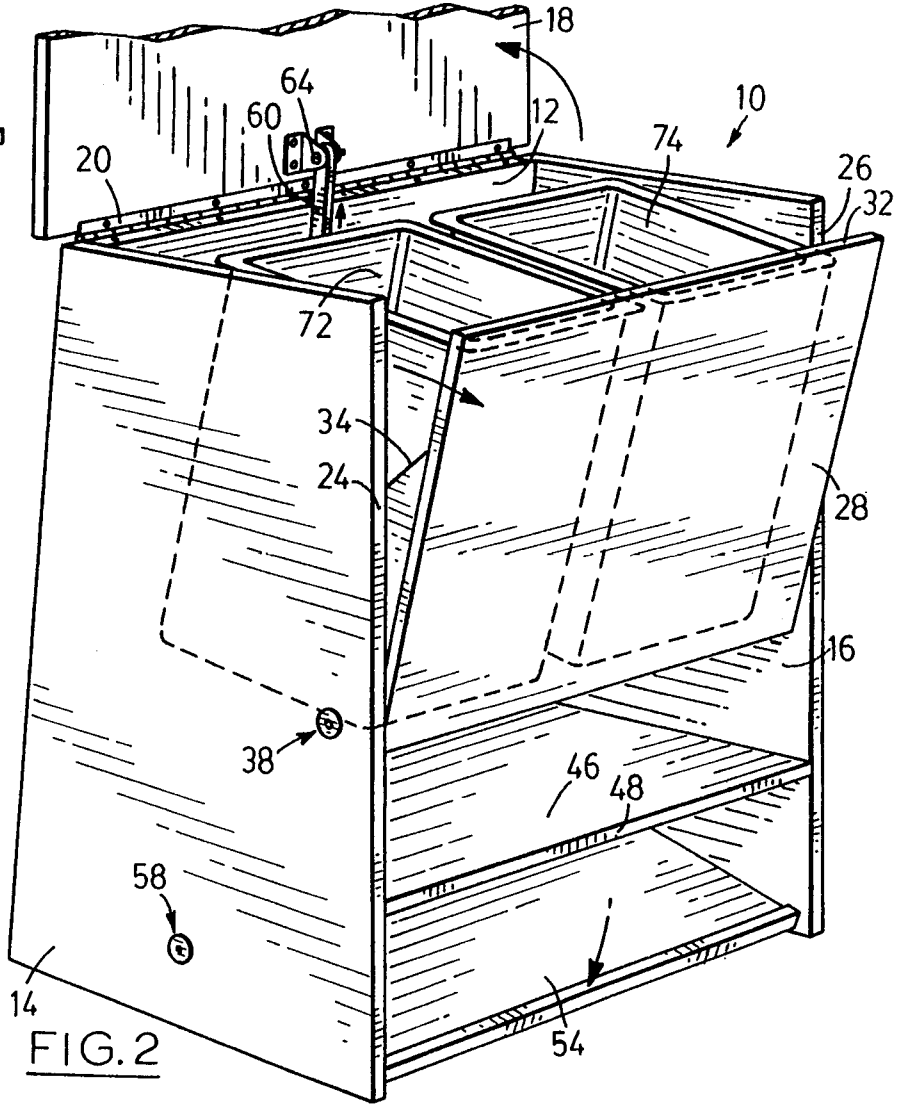
FIG. 2 is a similar view showing the container in the open configuration.

Referring to the drawings, a domestic garbage container has a housing 10 with a rear wall 12, opposite side walls 14, 16 extending forwardly therefrom and a lid 18 connected by a hinge 20 to the top of the rear wall 12 so as to rest on the top of the side walls 14, 16 in the closed position.

A waste supporting platform 22 is located in the housing 10 at a location which is just less than half the height of the housing 10. The platform 22 extends over substantially the whole area of the interior of the housing 10 between the side walls 14, 16 and from the rear wall 12 to the front edges 24, 26 of the side walls 14, 16 respectively. A front wall 28 extends upwardly from the front edge 30 of the platform 22 and has a top edge 32 level with the top of the side walls 14, 16 in the closed configuration. A pair of corner members 34, 36 are secured to the platform 22 and front wall 28 at opposite sides thereof for strengthening purposes. In the closed configuration, the outer surface of the front wall 28 is in the same vertical plane as the front edges 24, 26 of the side walls 14, 16.

Figure 4:
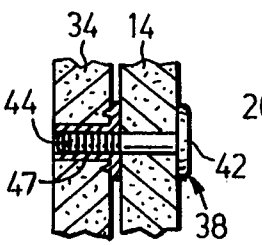
FIG. 4 is a sectional view along the line 4—4 of FIG. 3 showing one of the pivotal connections between the platform and side walls.

The platform 22 is pivotly connected adjacent its front edge 30 to the side walls 14, 16 adjacent their front edges 24, 26 by pivotal mountings 38, 40 respectively. The pivotal mounting 38 is shown in detail in FIG. 4 and comprises a bolt 42 whose shank 44 passes through an aperture in side wall 14 into threaded engagement with a nut 47 anchored in an aperture in the corner member 34. Corner member 34 can thus pivot about the shank 44. The pivotal mounting 40 is of similar construction.

A shelf 46 located below platform 22 is secured at opposite side edges to the side walls 14, 16. The front edge 48 of shelf 46 is in the same vertical plane as the front edges 24, 26 of the side walls 14, 16 and the outer surface of the front wall 28. The rear edge 50 of shelf 46 is spaced from the rear wall 12, and a back wall 52 extends upwardly from the shelf rear edge 50 to a height such that the platform 22 can rest on the top of the wall 52 when the container is in the closed configuration.

A shelf-like pedal member 54 is located below the shelf 46 and extends for substantially the whole width of the container between the side walls 14, 16 and also extends for substantially the whole distance from the front edges 24, 26 of the side walls 14, 16 to the rear wall 12 except that the rear edge of the pedal member 54 is somewhat spaced from the rear wall 12. The pedal member 54 is mounted for pivotal movement about a horizontal axis intermediate its front and rear edges by two pivotal mountings 56, 58, similar to the pivotal mountings 38, 40, and secured in the side edges of the pedal member 54 and the respective side walls 14, 16. In the closed configuration of the container, the pedal member 54 is substantially horizontal, as shown in FIGS. 1 to 3.

A rigid elongated connecting member 60 is pivotally connected at its lower end at 62 to the rear of the pedal member 54 and is pivotally connected at its upper end at 64 to the rear underside of the lid 18. Intermediate its ends, the connecting member 60 is also pivotally connected to the rear of the platform 22, the pivotal connection being formed by the connecting member 60 passing through a slot 64 in the rear edge of the platform 22 and having transverse platform-engaging rods 66, 68 above and below the platform 22.

Figure 1:
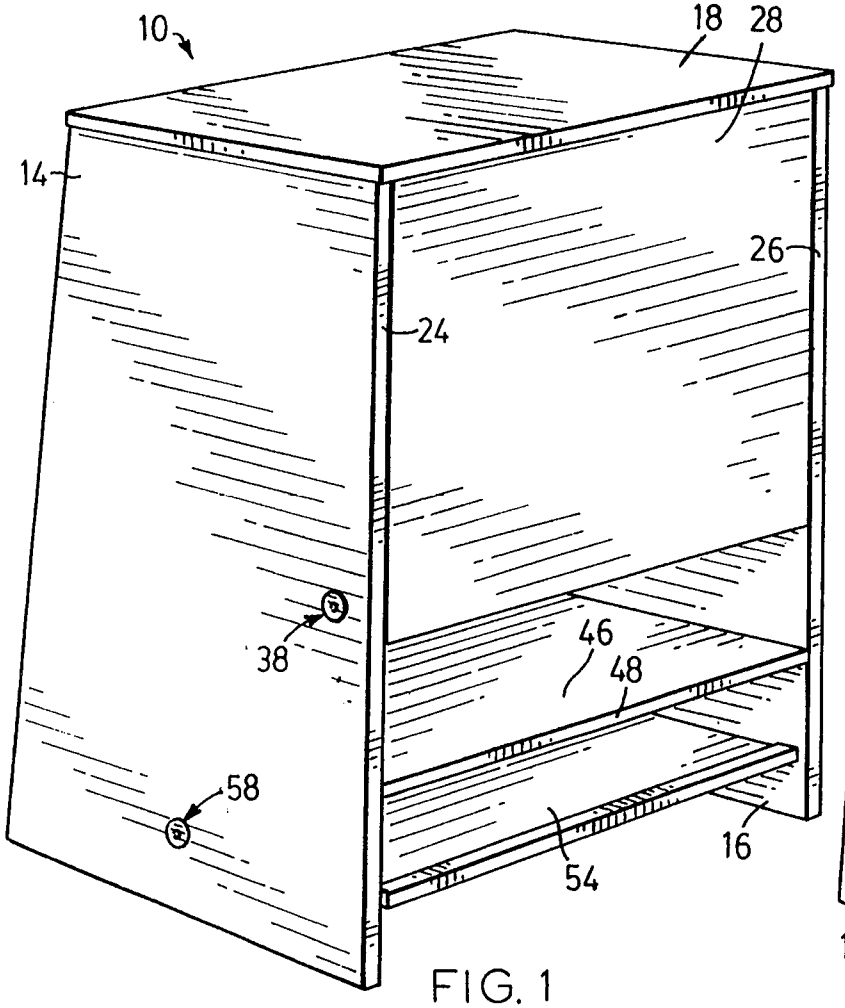
FIG. 1 is a perspective view of a garbage container in accordance with the invention in the closed configuration.
Figure 3:
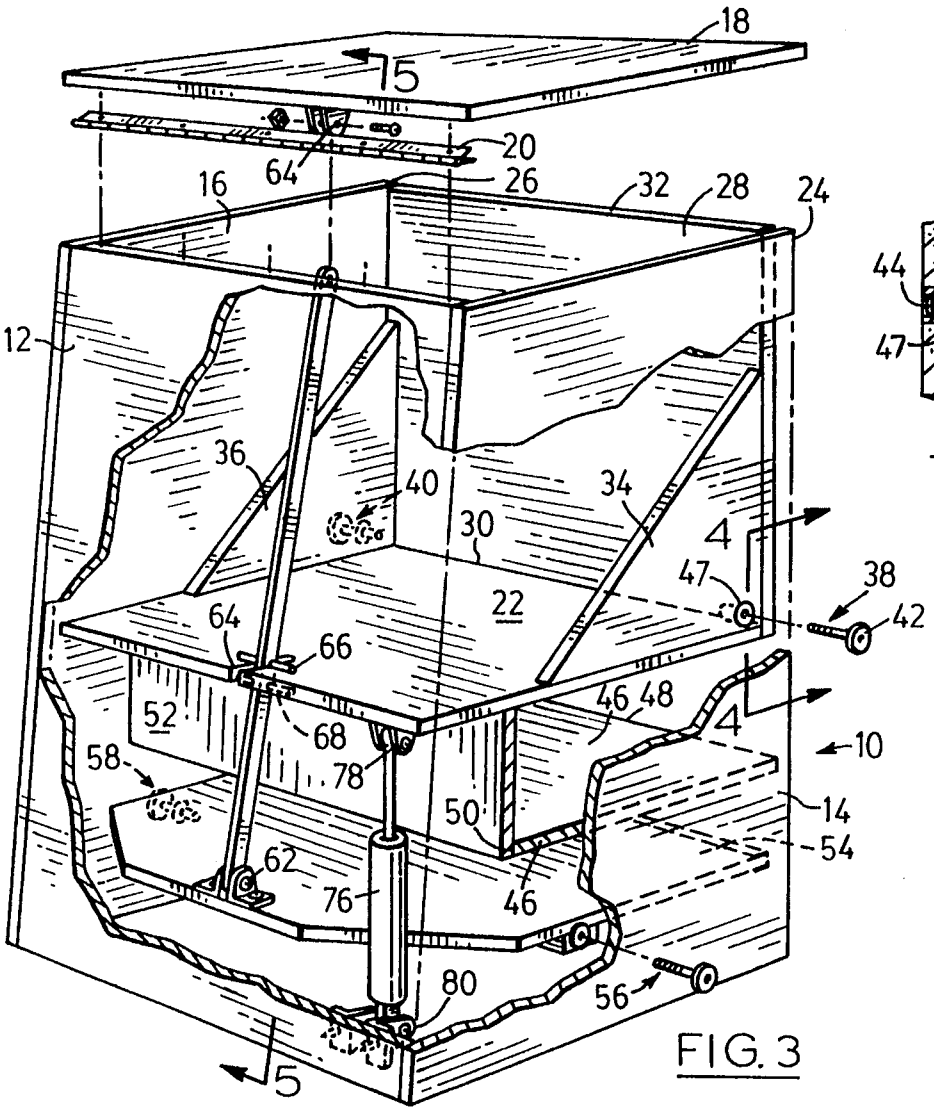
FIG. 3 is a partially broken away and partially exploded view of the container from the rear and side.

In the closed configuration shown in FIGS. 1 and 3, the member 54 and platform 22 are substantially horizontal, with the platform 22 resting on the top edge of shelf back wall 52, and the lid 18 is closed to give the container a neat appearance as clearly indicated in FIG. 1.

Figure 5:
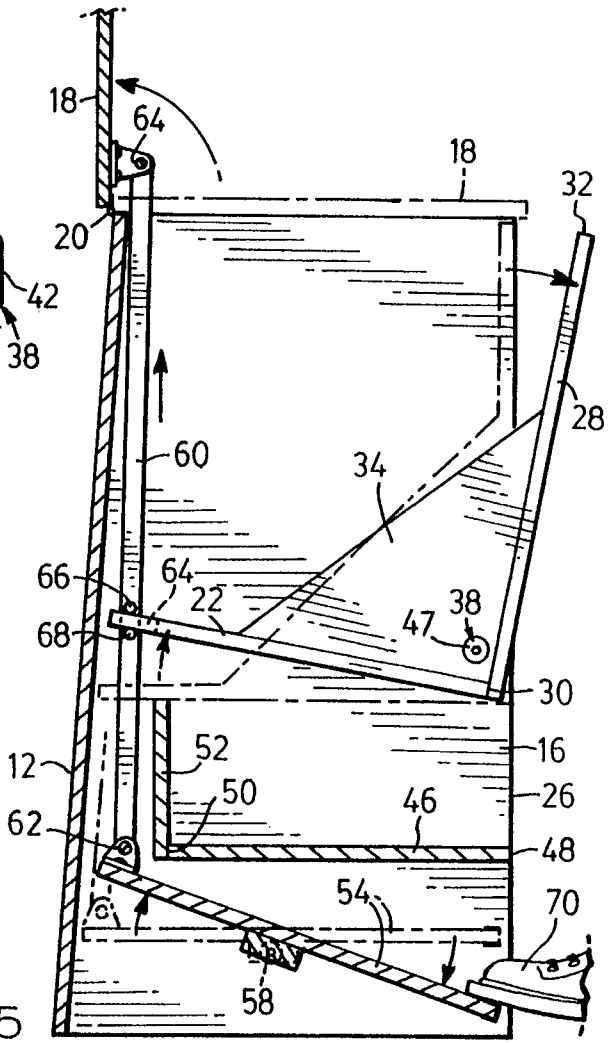
FIG. 5 is a sectional view taken partially along line 5—5 of FIG. 3 but showing the container in the open configuration.

To open the container, the forward portion of the pedal member 54 is pivoted downwardly by a foot 70 (FIG. 5) resulting in upward movement of the rear portion of the platform 54. The connecting member 60 is thereby moved upwardly, as indicatead particularly in FIG. 5, to both open the lid 18 and pivot the platform 22 upwardly about pivotal mountings 38, 40 and consequently to pivot the front wall 28 forwardly, as shown particularly in FIG. 2. Access to the interior of the container is clearly facilitated by the forward pivotal movement of the front wall 28. If desired, two separate waste receptacles may be placed side by side on the platform 22, see FIG. 2.

When the foot 70 is removed from the pedal member 54, the weight of the platform 22 and the lid 18 return the pedal member 54, the platform 22 and front wall 28 and lid 18 to the closed configuration. The closing movement may be controlled to a suitable low speed by a damper 76 pivotally connected at 78 at its upper end to the rear of platform 22 and at its lower end at 80 to a lower part of the interior of the rear wall 12, see FIG. 3.

The shelf 46 may be used for any suitable purpose, such as for example the temporary storage of old newspapers.

The advantages of the invention will be clear from the foregoing description of a preferred embodiment. Other embodiments will be readily apparent to a person skilled in the art, the scope of the invention being defined by the appended claims.

I claim:

1. A garbage container comprising:

a housing having a rear wall, opposite side walls extending forwardly therefrom and a lid hingedly connected to the top of the rear wall and extending forwardly therefrom so as to rest on the top of the side walls in a closed position, a waste supporting platform within the housing and pivotally connected adjacent its front edge to the opposite side walls for pivotal movement about a horizontal axis, a front wall extending upwardly from the front edge of the platform and having a top edge level with the top of the side walls in the closed position, and a connecting member pivotally connected to a rear portion of the platform and to a rear portion of the underside of the lid to cause upward opening movement of the lid to pivot the platform upwardly about its pivotal connection to the side walls with resultant forward pivotal movement of the front wall to facilitate access to the interior of the container.

2. A garbage container according to claim 1 wherein a pedal member is mounted within the housing below the platform for pivotal movement about a horizontal axis intermediate the front and rear ends of the pedal member, and said connecting member is also pivotally connected to a rear portion of the pedal member, said pedal member having a front portion adjacent to the front of the housing moveable downwardly by a human foot to cause upward movement of the rear portion of the pedal member with consequent upward movement of the connecting member to effect said upward pivotal movement of the lid and platform and forward pivotal movement of the front wall.

* * * * *